US007963636B2

(12) United States Patent
Yamane

(10) Patent No.: US 7,963,636 B2
(45) Date of Patent: Jun. 21, 2011

(54) LIQUID EJECTION HEAD

(75) Inventor: Toru Yamane, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 804 days.

(21) Appl. No.: 11/935,618

(22) Filed: Nov. 6, 2007

(65) Prior Publication Data

US 2008/0111868 A1 May 15, 2008

(30) Foreign Application Priority Data

Nov. 15, 2006 (JP) ..... 2006-309125

(51) Int. Cl.
*B41J 2/05* (2006.01)

(52) U.S. Cl. ..... 347/65
(58) Field of Classification Search ..... 347/61–63, 347/65, 71
See application file for complete search history.

(56) References Cited

U.S. PATENT DOCUMENTS 6,726,308 B2 4/2004 Lee et al.

FOREIGN PATENT DOCUMENTS

JP 54-051837 4/1979
JP 58140259 A * 8/1983

* cited by examiner

*Primary Examiner* — Matthew Luu
*Assistant Examiner* — Lisa M Solomon
(74) *Attorney, Agent, or Firm* — Fitzpatrick, Cella, Harper & Scinto

(57) ABSTRACT

A liquid ejecting head is constituted by a substrate to which elements for generating energy utilized for ejecting liquid and a supply port for supplying the liquid to be ejected are provided; a plurality of ejection outlets, for ejecting the liquid, provided corresponding to the elements; pressure chambers each communicating with an associated ejection outlet; and flow paths communicating between the pressure chambers and the supply port. The flow paths include at least one pair of flow paths connected to an associated pressure chamber in a symmetrical manner and include flow paths overlapping with each other with respect to a direction from an associated ejection outlet toward the substrate.

9 Claims, 13 Drawing Sheets

(a)

(b)

(a)

(b)

(c)

LIQUID EJECTION HEAD

FIELD OF THE INVENTION AND RELATED ART

The present invention relates to a liquid ejection head for ejecting liquid by externally imparting energy to the liquid such as ink droplets or the like. Particularly, the present invention relates to a liquid ejection head for ejecting liquid by utilizing kinetic energy generated by causing the liquid to bubble generation by thermal energy.

An ink jet recording head for ejecting ink droplets by externally imparting energy to the ink droplets has been known. An ink jet recording method using the ink jet recording head of this type has been disclosed in Japanese Laid-Open Patent Application (JP-A) Sho 54-51837. This ink jet recording method is different from other ink jet recording methods in that motive force for ejecting droplets is obtained by applying thermal energy to the liquid. More specifically, the recording method disclosed in JP-A Sho 54-51837 is characterized in that liquid to which thermal energy is applied is heated to generate bubbles so that droplets are ejected from orifices (ejection outlets) at an end of a recording head portion by acting force on the basis of the bubble generation. Recording of information is effected by attaching the droplets to a recording member.

The recording head used in this recording method is generally provided with a liquid ejection portion including ejection outlets provided for ejecting liquid and liquid flow paths partially constituted by a thermally acting portion which is a portion, communicating with the ejection outlets, where thermal energy for ejecting droplets acts on the liquid. Further, this recording head includes a heat generating resistance layer as an electrothermal transducer which is an energy generating element for generating energy, an upper protective layer for protecting the heat generating resistance layer from ink, and a lower layer for accumulating heat.

In recent years, in order to realize high-definition image recording at higher speed, a need for stably and accurately flying smaller droplets in a desired direction is increased. A nozzle constitution generally well known with respect to such a need is shown in FIGS. 13 and 14. As shown in FIGS. 13 and 14, this nozzle includes a heater 111 disposed in each of bubble generation chamber 112 for causing ink to generate a bubble and ejects an ink droplet from an ejection outlet (not shown) located at an upper portion of the heater 111. In each bubble generation chamber 112, an ink flow path 113 for supplying ink is provided and communicates with a common liquid chamber 117.

Further, as shown in FIGS. 15 and 16, a constitution in which a plurality of ink flow paths 113 is provided with respect to each bubble generation chamber 112 is also disclosed. Such a constitution is also disclosed in U.S. Pat. No. 6,726,308.

However, as shown in FIG. 13, in the conventionally well-known nozzle structure, one ink flow path 113 is disposed on one side of the bubble generation chamber 112 in which the heater 111 is disposed. For this reason, as shown in FIG. 14, a bubble 121 generated on the heater 111 is biased toward the ink flow path 113 side during bubble collapse, so that an ink droplet 122 ejected from an ejection outlet 116 is deviated with respect to an ejection direction.

In order to solve this problem, as shown in FIGS. 15 and 16, constitutions in which two ink flow paths 113 are provided with respect to each bubble generation chamber 112 are employed. According to these constitutions, a certain improvement is achieved but by employing only the constitutions providing a plurality of ink flow paths with respect to each bubble generation chamber 112, the problem does not result in a fundamental solution for maintaining symmetry with respect to bubble generation/collapse. Accordingly, even in such constitutions, there also arises the problem of an occurrence of deviation of ink droplet ejection direction due to asymmetry with respect to bubble generation/collapse.

Further, by employing the above described constitutions, as indicated by a dimension P in FIG. 16, a nozzle pitch is increased, so that the constitutions result in a contradictory constitution in terms of such a demand that nozzles are arranged with a high density to improve a recording density.

SUMMARY OF THE INVENTION

A principal object of the present invention is to provide a liquid ejection head capable of effecting high-quality recording by ejecting droplets with high density while suppressing deviation of a droplet ejection direction.

According to an aspect of the present invention, there is provided a liquid ejecting head comprising:

a substrate to which elements for generating energy for ejecting liquid and a supply port for supplying the liquid to be ejected are provided;

a plurality of ejection outlets, for ejecting the liquid, provided corresponding to the elements;

pressure chambers each communicating with an associated ejection outlet; and flow paths communicating between the pressure chambers and the supply port, wherein the flow paths include at least one pair of flow path portions connected to an associated pressure chamber in a symmetrical manner and include a flow path portion overlapping with each other with respect to a direction from an associated ejection outlet toward the substrate.

According to the present invention, asymmetry of bubble generation/collapse phenomenon with respect to a center of a principal surface of an energy generating element in each bubble generation chamber is substantially completely eliminated, so that it is possible to prevent deviation of a droplet ejection direction caused due to the asymmetry. As a result, it is possible to effect high-quality recording and eject droplets with high density.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

First Embodiment

FIGS. 1 to 6 are schematic views for illustrating an ink jet recording head according to First Embodiment of the present invention.

Figure 4:
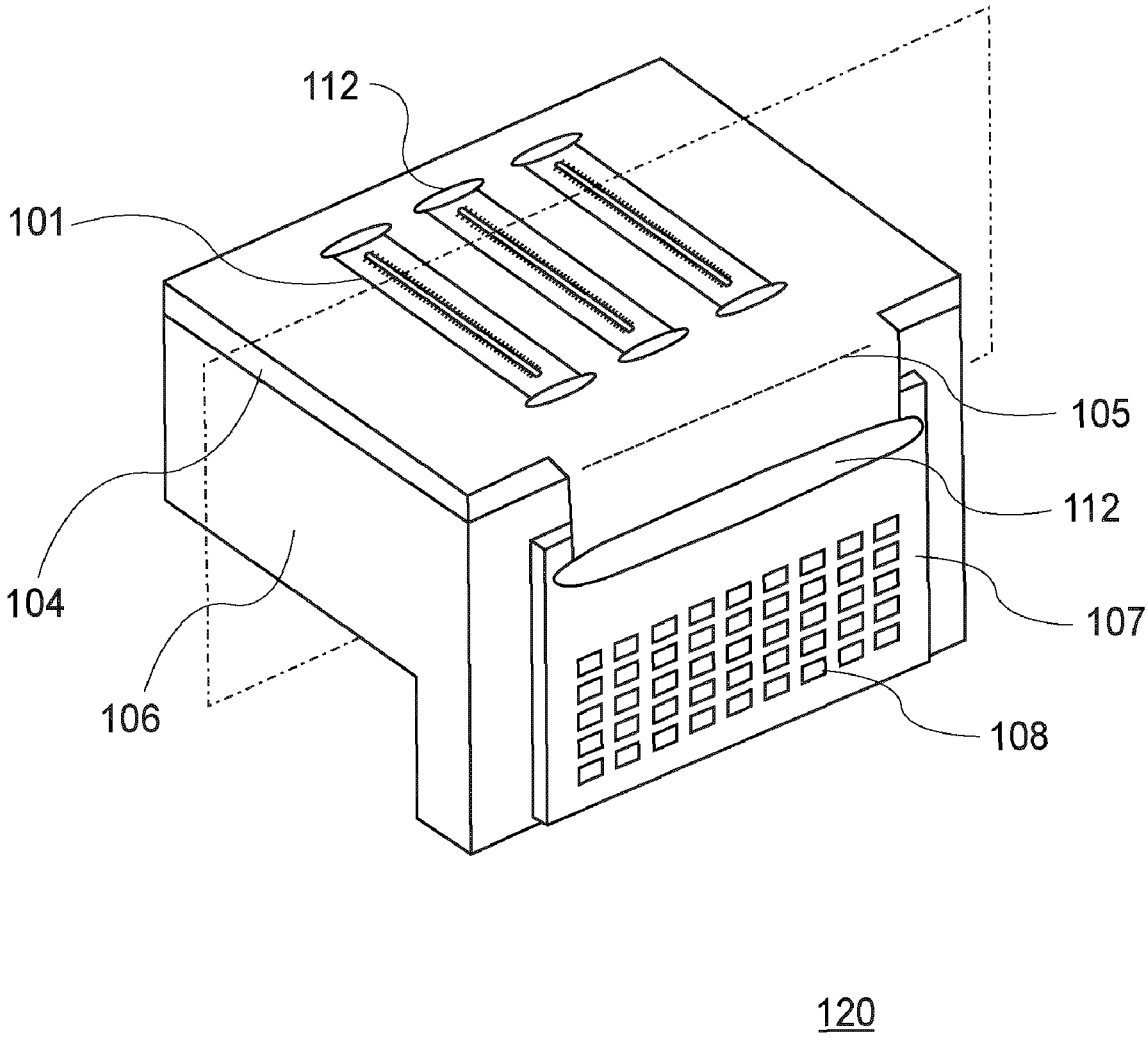
FIG. 4 is a perspective view schematically showing the ink jet recording head in First Embodiment.
Figure 5:
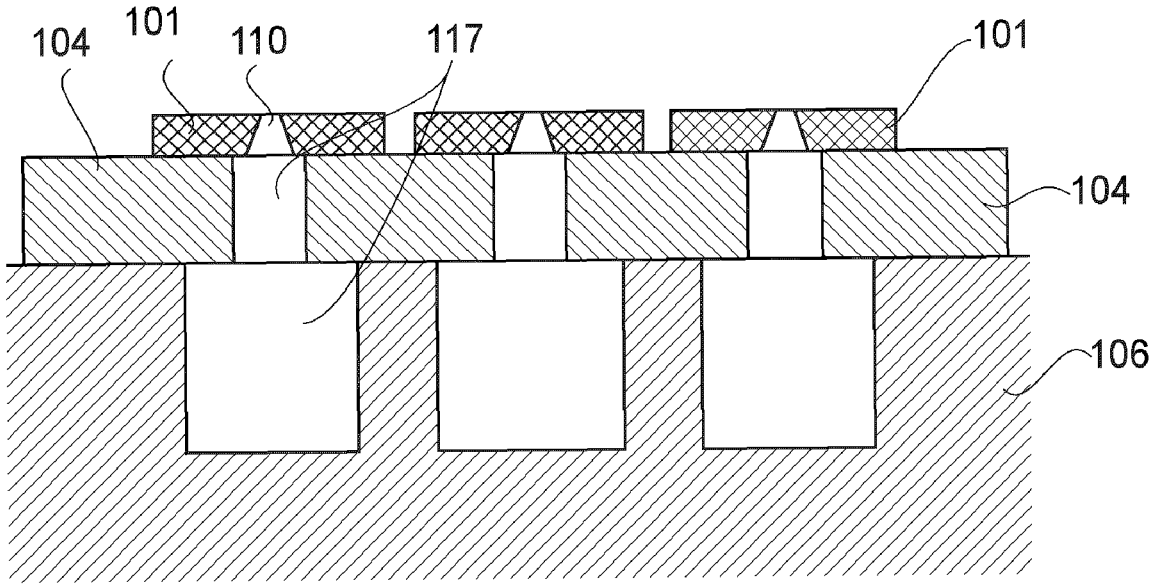
FIG. 5 is a sectional view schematically showing the ink jet recording head in First Embodiment.

FIG. 4 is a perspective view showing an outer appearance of the ink jet recording head. FIG. 5 is a sectional view, taken along alternate long and short dashed lines indicated in FIG. 4, schematically showing the ink jet recording head.

As shown in FIGS. 4 and 5, an ink jet recording head 120 of this embodiment is principally constituted by a supporting member 106 on which a supporting substrate 104 provided with a silicon substrate 101 thereon, an electric circuit board (substrate) 107, and a flexible circuit board (substrate) 105 are mounted. The ink jet recording head of this embodiment effects recording on a recording material by ejecting ink from nozzles provided on the silicon substrate 101 depending on an electric signal externally inputted through electrical contacts 108.

The electric signal inputted through the electrical contacts 108 is transmitted to a circuit pattern provided on the silicon substrate 101 via the flexible circuit board 105 connected to the electric circuit board 107. Through this circuit pattern, a heater as an energy generating element provided on the silicon substrate 101 is heated. On the heater, ink as a liquid to be subjected to bubble generation is guided and heated during heating of the heater to generate bubbles, so that the ink is ejected from an associated nozzle provided at an upper portion of the heater by utilizing kinetic energy of the generated bubbles. The ink on the heater is supplied to each bubble generation chamber (pressure chamber) through an ink supply port 110 provided in the silicon substrate 101 as a through hole in a thickness direction of the silicon substrate 101. The ink supply port 110 communicates with a common liquid chamber 117 constituted by a hole provided in the supporting substrate 104 and a groove (recess) provided to the supporting member 106 as shown in FIG. 5 and is constituted so as to be supplied with the ink from an ink container (not shown).

Figure 3:
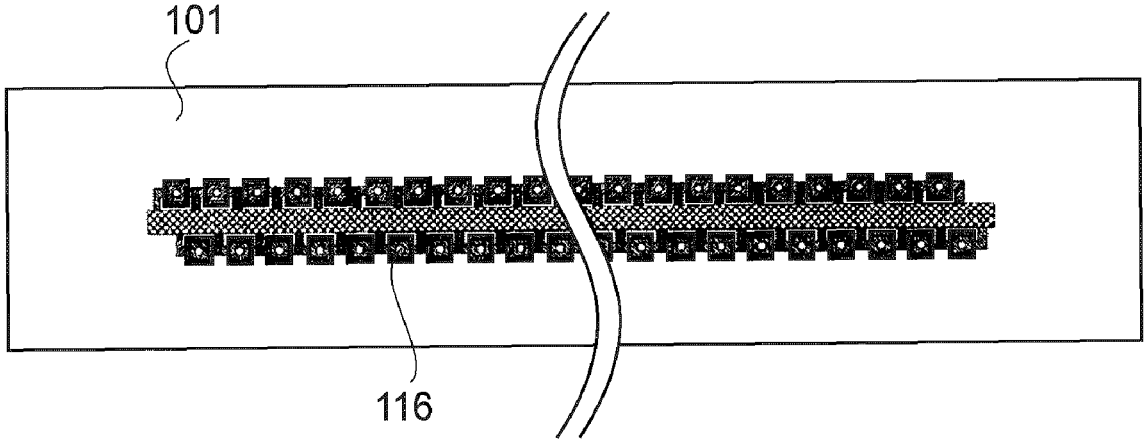
FIGS. 3(*a*) and 3(*b*) are schematic views showing a silicon substrate of the ink jet recording head in First Embodiment.
Figure 3:
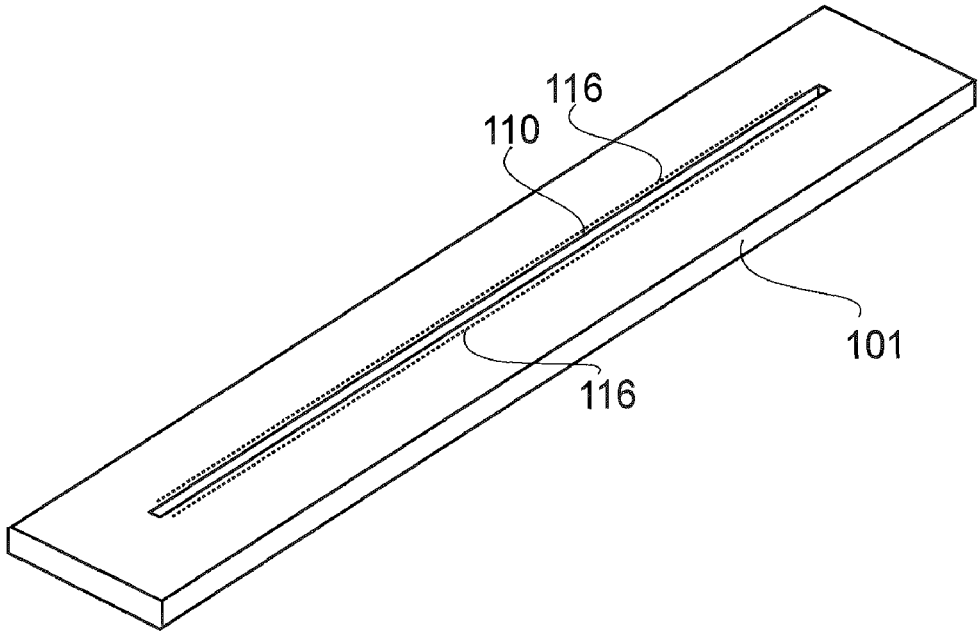
Figure 6:
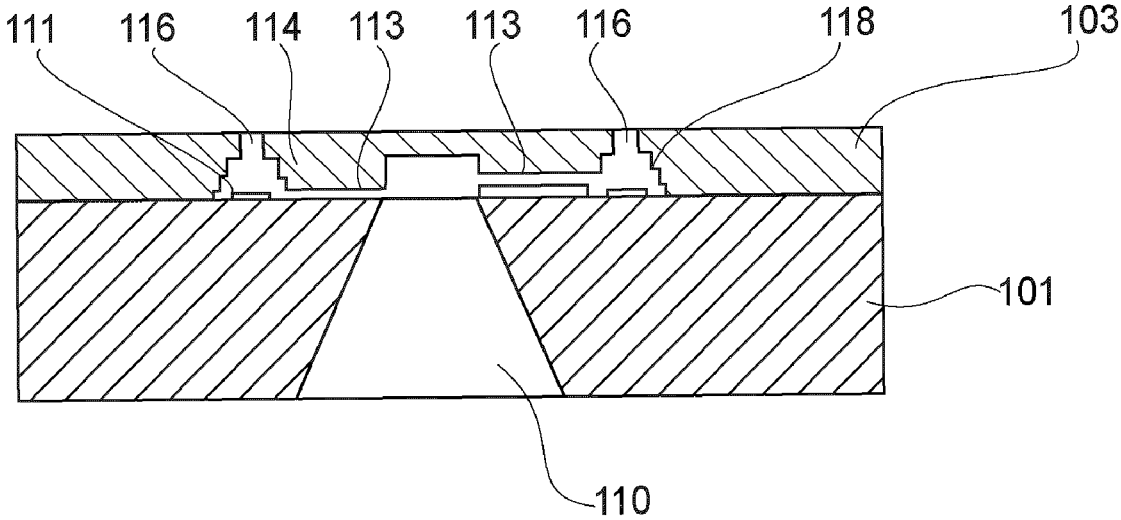
FIG. 6 is a sectional view showing the silicon substrate of the ink jet recording head in First Embodiment.

FIGS. 3(*a*) and 3(*b*) show the silicon substrate 101 of the ink jet recording head 120. FIG. 3(*a*) is a plan view showing the silicon substrate 101, and FIG. 3(*b*) is a perspective view schematically showing the silicon substrate 101. As described above, at a central portion of a principal surface of the silicon substrate 101, an elongated ink supply port 110 is provided so as to pass through the silicon substrate 101. On the silicon substrate 101, two series of cylindrical ejection outlets 116 for ejecting the ink are arranged so as to sandwich the ink supply port 110 with respect to a longitudinal direction of the ink supply port 110. FIG. 6 is a sectional view of the silicon substrate 101. As shown in FIG. 6, at an upper surface of the silicon substrate 101, a nozzle material 103 provided therein with ink flow paths 113 and nozzles 118 is disposed. The nozzle member is further provided with ejection outlets 116 at an upper portion there of and heaters 111 at a bottom thereof.

Figure 1:
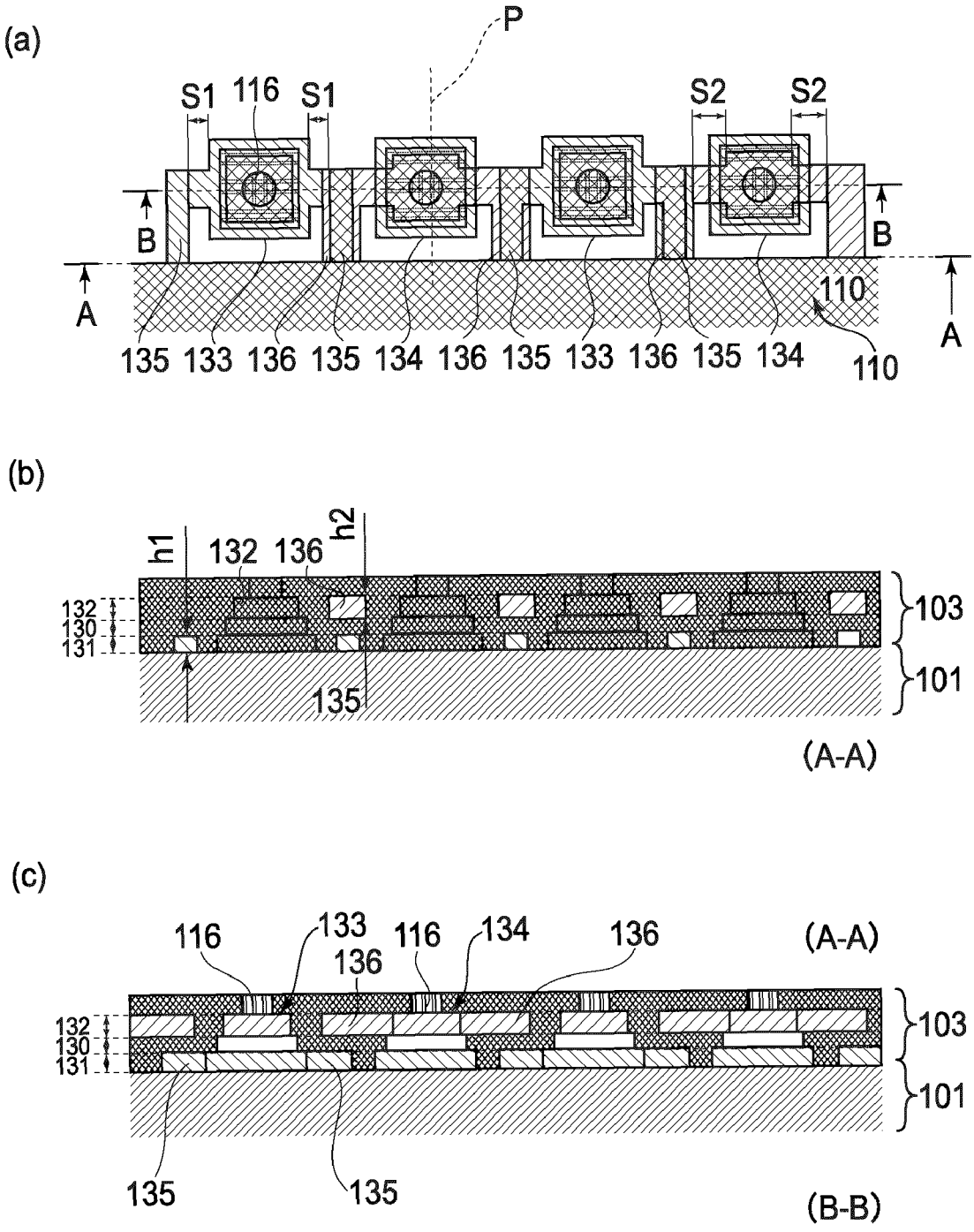
FIGS. 1(*a*) to 1(*c*) are schematic views showing a nozzle portion of an ink jet recording head in First Embodiment of the present invention.

Next, a nozzle structure of the ink jet recording head of this embodiment will be described with reference to FIGS. 1(*a*) to 1(*c*). FIG. 1(*a*) is a plan view showing a major portion of the ink jet recording head of this embodiment. FIG. 1(*b*) is a sectional view taken along A-A line indicated in FIG. 1(*a*), FIG. 1(*c*) is a sectional view taken along B-B line indicated in FIG. 1(*a*). In this embodiment, ink flow paths are constituted as a multi-layer space formed in a nozzle material 103 and in order to clearly illustrate a constitution of layers, the layers are indicated by different hatching portions in FIGS. 1(*a*) to 1(*c*) even in the case where the layers communicate with each other as an ink flow path. In FIG. 1(*a*), the nozzle material 103 is omitted.

As shown in FIG. 1(*b*), the nozzles of the ink jet recording head of this embodiment have a flow path structure formed as a space in the nozzle material 103 disposed on the silicon substrate 101. As shown in FIG. 1(*c*), at an uppermost surface of the nozzle material 103, ejection outlets 116 for ejecting the ink are formed in an open state. Each of first and second bubble generation chambers (pressure chambers) 133 and 134 is provided corresponding to each ejection outlet 116. Each of the first and second bubble generation chambers 133 and 134 is constituted as a lamination structure having three layers consisting of a first ink flow path layer 131, an intermediary layer 130, and a second ink flow path layer 132 in this order on the silicon substrate 101. The first and second bubble generation chambers 133 and 134 are provided with a pair of first ink flow paths 135 and a pair of second ink flow paths 136, respectively. Each of the pair of first ink flow path layer 135 provided to the first bubble generation chamber 133 and the pair of second ink flow path layer 136 provided to the second bubble generation chamber 134 is, as shown in FIG. 1(*a*), disposed at line-symmetrical positions with respect to a straight line P which passes through a center line of an associated heater at a principal surface of the heater and is perpendicular to a nozzle arrangement direction. Each of the pair of first ink flow path layer 135 and the pair of second ink flow path layer 136 is formed in a symmetrical shape with respect to an associate bubble generation chamber 133 or 134 so as to have the same flow resistance.

Each of the ink flow paths 135 and 136 has inlet portions, as end portions adjacent to an associated bubble generation chamber 133 or 134, formed in straight shape with a dimension S1 or S2 as shown in FIG. 1(*a*) in a direction parallel to the nozzle arrangement direction. By constituting the respective ink flow paths 135 and 136 as described above, an occurrence of asymmetry with respect to behavior of ink and bubble in the bubble generation chambers 133 and 134 during bubble generation/collapse by the heater 111 is prevented.

The nozzle material 103 includes two types of the first bubble generation chambers 133 and the second bubble generation chambers 134 which are alternately arranged in a row. To the first bubble generation chamber 133, ink is supplied from the first ink flow path layer 135 formed as a first flow path layer 131 (thickness: h1). To the second bubble generation chamber 134, ink is supplied from the second ink flow path layer 136 formed as a second flow path layer 132 (thickness: h2).

As a result, the first ink flow path 135 and the second ink flow path 136 adjacent to the first ink flow path 135 in the nozzle arrangement direction are located at overlapping positions when these ink flow paths are projected on a plane parallel to the principal surface of the silicon substrate 101 (i.e., overlap with each other. Therefore, it is possible to arrange nozzles with high density in such a manner that each nozzle has the bubble generation chamber 133 or 134 provided with opposite ink inlet portions sandwiching the bubble generation chamber.

In this embodiment, all the nozzles arranged in the nozzle arrangement direction are set to provide the same amount of ink ejection, so that flow resistances of the first and second ink flow path layers 135 and 136 are constituted so as to be substantially equal to each other.

Figure 2:
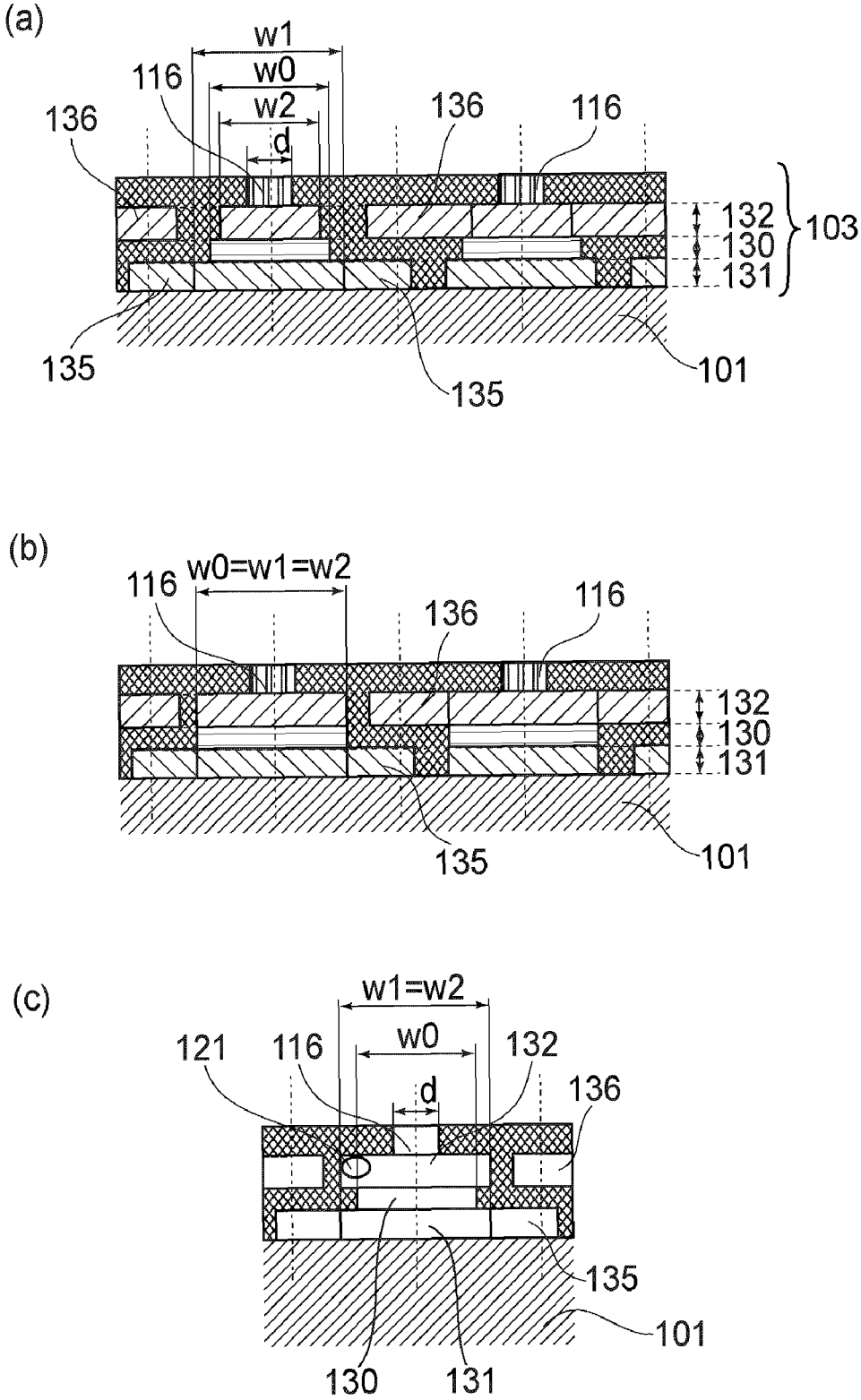
FIGS. 2(*a*) to 2(*c*) are schematic views for illustrating the nozzle portion of the ink jet recording head in First Embodiment.

With respect to widths W1, W0, and W2 of the first flow path layer 131, the intermediate layer 130, and the second flow path layer 132, respectively, constituting each of the first and second bubble generation chambers 133 and 134, the relationship: W2<W0<W1 is satisfied in this embodiment as shown in FIG. 2 (*a*). Incidentally, the present invention is essentially applicable to other constitutions satisfying the relationship: W0=W1=W2 as shown in FIG. 2(*b*) and the relationship: W0<W1=W2 as shown in FIG. 2(*c*).

However, in the case where the width W2 of the second flow path layer 132 is excessively larger than a diameter d of the ejection outlet 116, as shown in FIG. 2(*c*), a bubble 121 can remain in the second flow path layer 132 located under the ejection outlet 116 to cause ejection failure. For this reason, it is desirable that each of the bubble generation chambers 133 and 134 is constituted so as not to form a relatively large stepped portion to the extent possible in order to satisfy a relationship: W1>W0>W2>d with respect to the diameter d of the ejection outlet 116 and the respective widths W1, W0 and W2, as shown in FIG. 2(*a*).

As described above, the present invention is characterized by the following points (1) and (2).

(1) At least one pair of ink flow paths is provided to a bubble generation chamber of each nozzle so as to have a substantially equal flow resistance and has ink inlet portions, as end portions thereof disposed adjacent to the bubble generation chamber, formed in a straight shape. By this constitution, asymmetry of bubble generation/collapse phenomenon with respect to a center line on the principal surface of the heater of each bubble generation chamber is substantially eliminated completely to prevent deviation of ink droplet ejection direction caused due to the asymmetry.

(2) A pair of ink flow paths provided to a bubble generation chamber of a nozzle and a pair of ink flow paths provided to a bubble generation chamber of an adjacent nozzle with respect to the nozzle arrangement direction are independently disposed at different positions with respect to a thickness direction of the silicon substrate 101 and also disposed at overlapping positions where the ink flow paths disposed at different positions overlap with each other when projected on a plane parallel to the principal surface of the silicon substrate 101. By this constitution, it is possible to realize a high nozzle arrangement density.

According to the ink jet recording head of this embodiment, by employing the above described constitutions, it is possible to suppress deviation of the ink droplet and realize high-quality recording and ejection of ink droplet with high density.

Second Embodiment

Figure 7:
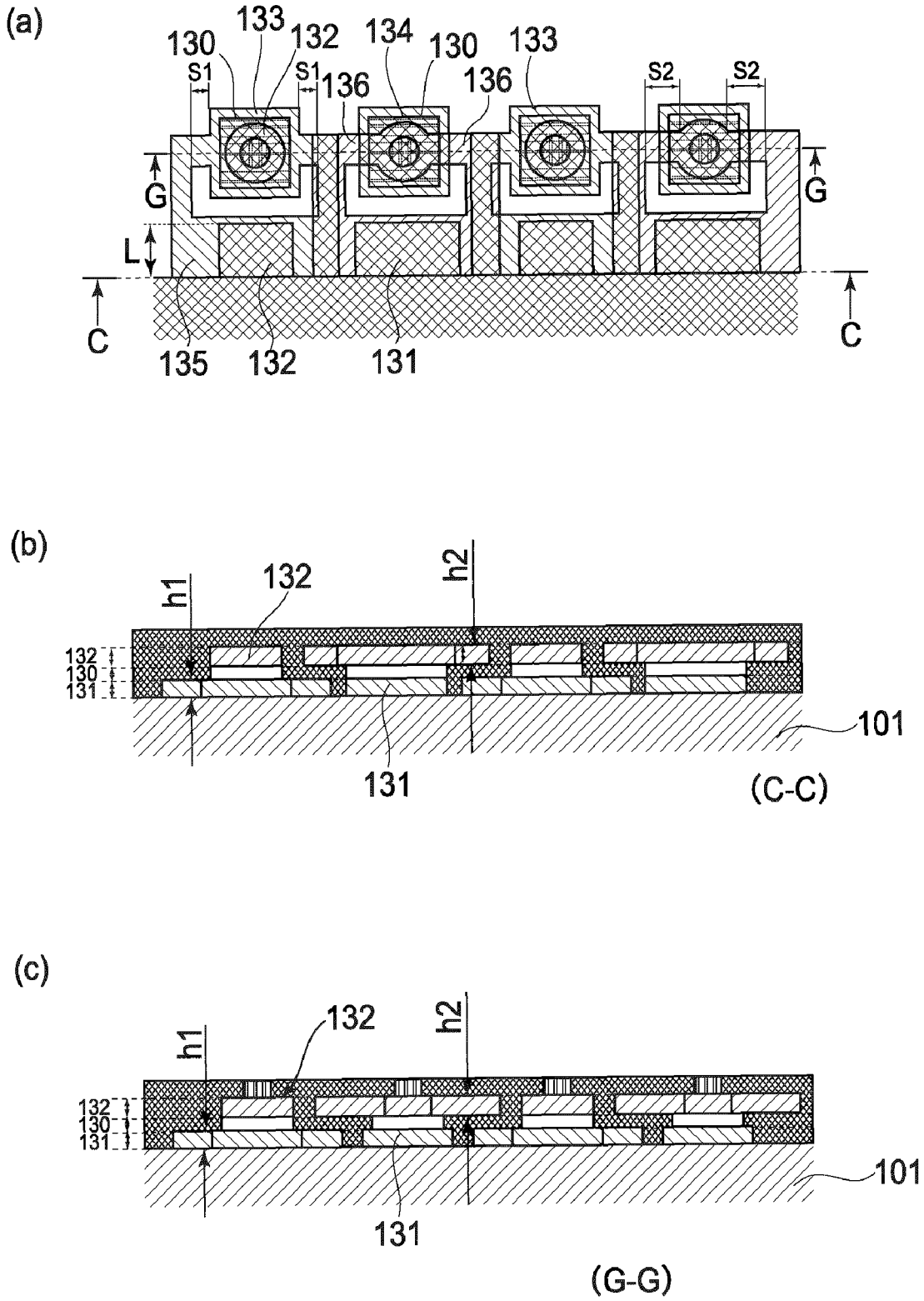
FIGS. 7(*a*) to 7(*c*), FIGS. 8(*a*) and 8(*b*), and FIGS. 9(*a*) to 9(*c*) are schematic views showing a nozzle portion of an ink jet recording head in Second Embodiment.

An ink jet recording head according to Second Embodiment will be described with reference to FIGS. 7 and 9. FIG. 7(*a*) is a plan view showing a major portion of the ink jet recording head of this embodiment. FIG. 7(*b*) is a sectional view taken along C-C line indicated in FIG. 7(*a*), and FIG. 7(*c*) is a sectional view taken along G-G line indicated in FIG. 7(*a*).

In this embodiment, a shape of each ink flow path is different from that in First Embodiment. In First Embodiment, the first ink flow path layer 135 and the second ink flow path layer 136 independently communicate directly with the ink supply port 110. On the other hand, in this embodiment, between the bubble generation chamber 133 or 134 and the ink supply port 110, three layers consisting of the first flow path layer 131, the intermediate layer 130, and the second flow path layer 132 are connected in the thickness direction of the silicon substrate 101 as shown in FIG. 7(*b*). Further, portions of the first ink flow path layer 135 communicate with each other in the first flow path layer 131, and portions of the second ink flow path layer 136 communicate with each other in the second flow path layer 132.

That is, each of the pair of ink flow paths 135 extended from the same bubble generation chamber 133 and the pair of ink flow paths 136 extended from the same bubble generation chamber 134 communicates with each other. As a result, in an area L constituting communication portions, a flow resistance can be reduced.

Figure 8:
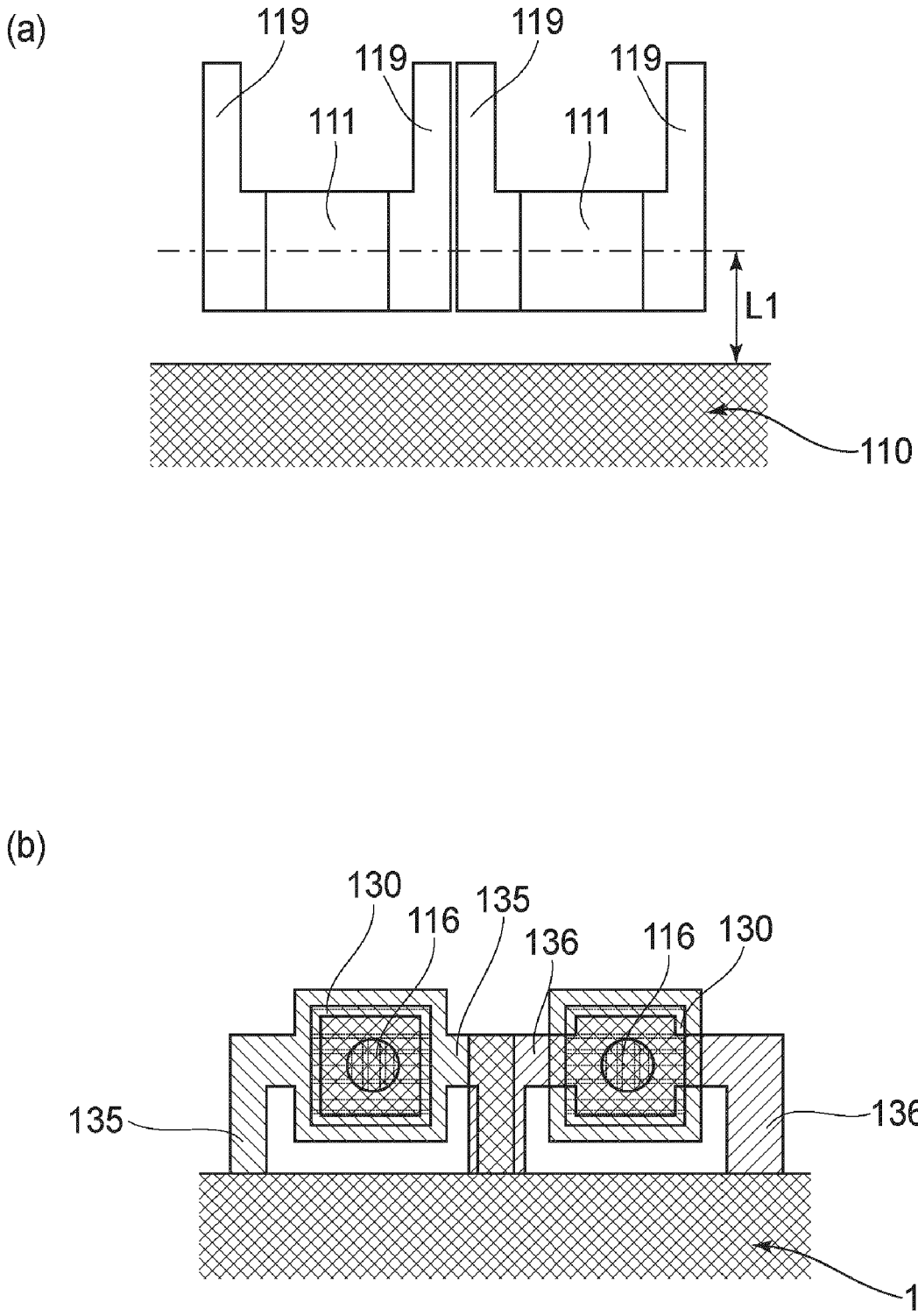

When a constitution in which electrodes 119 are extended from both sides of the heater 111 in the same direction as the heater arrangement direction as shown in FIG. 8(*a*) is employed, a flow resistance can effectively be reduced in the case of a constitution shown in FIG. 8(*b*) or the constitution of the respective ink flow paths in First Embodiment.

Figure 9:
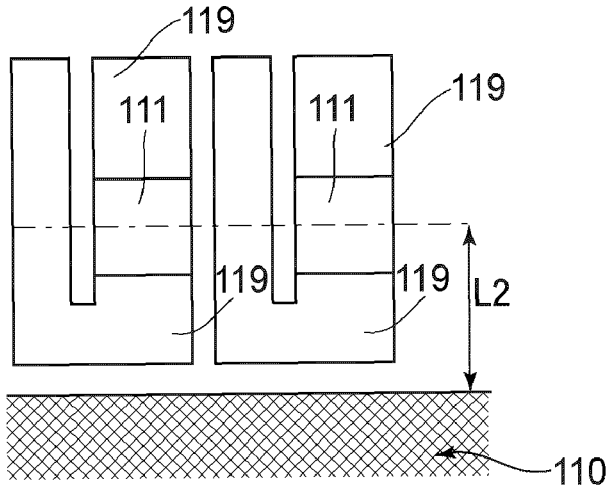
Figure 9:
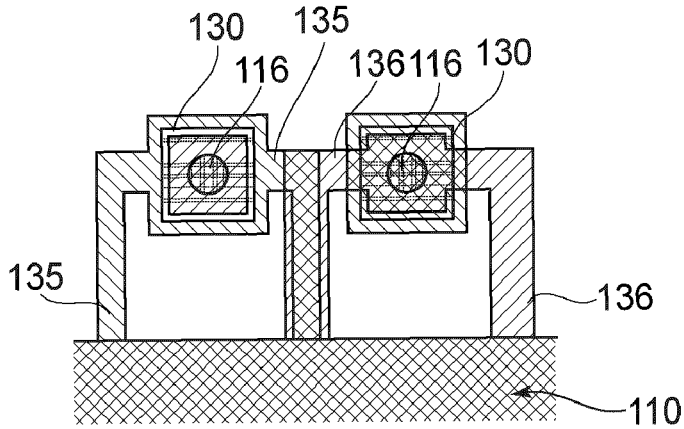
Figure 9:
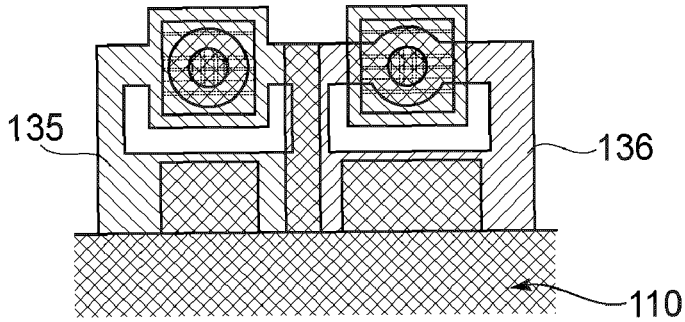

However, there is the case where the electrodes 119 are extended from the heater 111 in a direction perpendicular to the nozzle arrangement direction as shown in FIG. 9(*a*) in view of a size of the heater 111, line and space of arrangement of the electrodes 119, a pitch of heater arrangement, and the like. In this case, in the constitution in First Embodiment, a flow path shape results in that as shown in FIG. 9(*b*), so that there is a possibility of an increase in flow resistance of the ink flow paths (area L2>area L1).

In this embodiment, when the electrode arrangement shown in FIG. 9(*a*) is employed, as shown in FIG. 9(*c*), it is possible to particularly achieve an effect by causing the pair of first ink flow path layers 135 and the pair of second ink flow path layers 136 to communicate with each other in the first flow path layer 131 and the second flow path layer 132, respectively.

In the constitution shown in FIG. 7(*a*), an upper portion of the bubble generation chambers 133 and 134 constituted by the second flow path layer 132 has a circular shape. This constitution is intended to prevent an occurrence of bubble stagnation by decreasing a cross-sectional area at the upper portion of the bubble generation chamber 133 and 134. The shape of the upper portion of the bubble generation chamber 133 and 134 is not limited to the circular shape but may be appropriately changed.

As described above, in this embodiment, between the bubble generation chamber 133 and the ink supply port 110 and between the bubble generation chamber 134 and the ink supply port 110, three layers consisting of the first ink flow path layers 135, the second ink flow paths 136, and the intermediate layer 130 communicate with each other in the nozzle material 103. As a result, each of the pair of first ink flow path layers 135 extended from the same bubble generation chamber 133 and the pair of second ink flow path layers 136 extended from the same bubble generation chamber 134 communicate with each other to reduce the flow resistance. By employing such a constitution, it is possible to increase an ejection frequency of the ink jet recording head described in First Embodiment.

Third Embodiment

Figure 10:
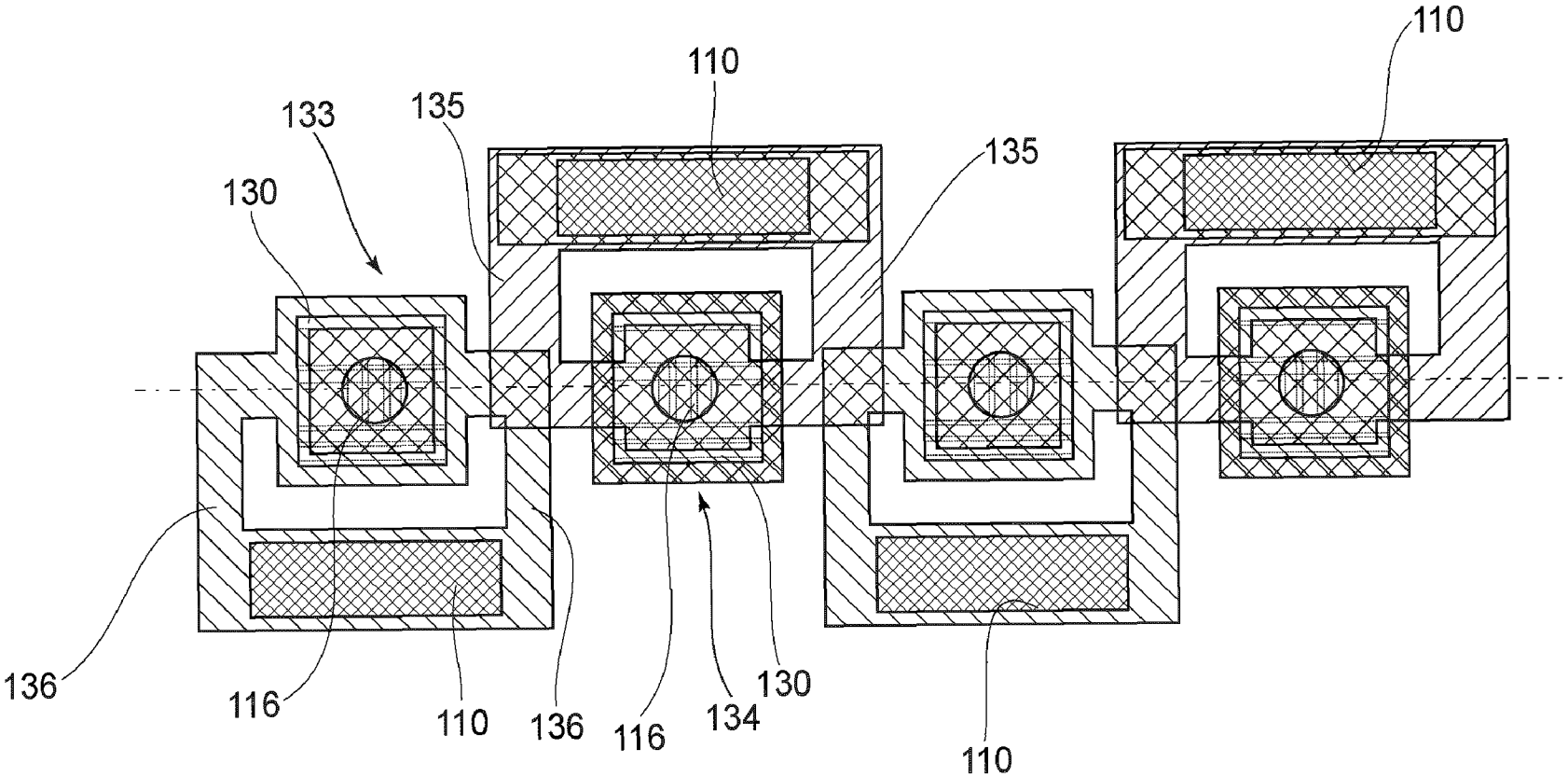
FIG. 10 is a schematic view showing a nozzle portion of an ink jet recording head in Third Embodiment.

An ink jet recording head of Third Embodiment will be described with reference to FIG. 10 showing a plan view illustrating a major portion of the ink jet recording head.

This embodiment is different from First and Second Embodiments described above in constitution of the ink supply port 110. In First and Second Embodiments, a common ink supply port 110 for all the nozzles is formed in the entire area with respect to the nozzle arrangement direction but in this embodiment, as shown in FIG. 10, ink supply ports 110 are independently formed with respect to each nozzle. The ink supply ports 110 are alternately disposed on both sides of the nozzles with respect to the nozzle arrangement direction.

As described above, the present invention is also applicable to the constitution in which the plurality of ink supply ports 110 is independently formed with respect to an associated bubble generation chamber 133 or 134 and can achieve a similar effect as in the above described embodiments.

Fourth Embodiment

Figure 11:
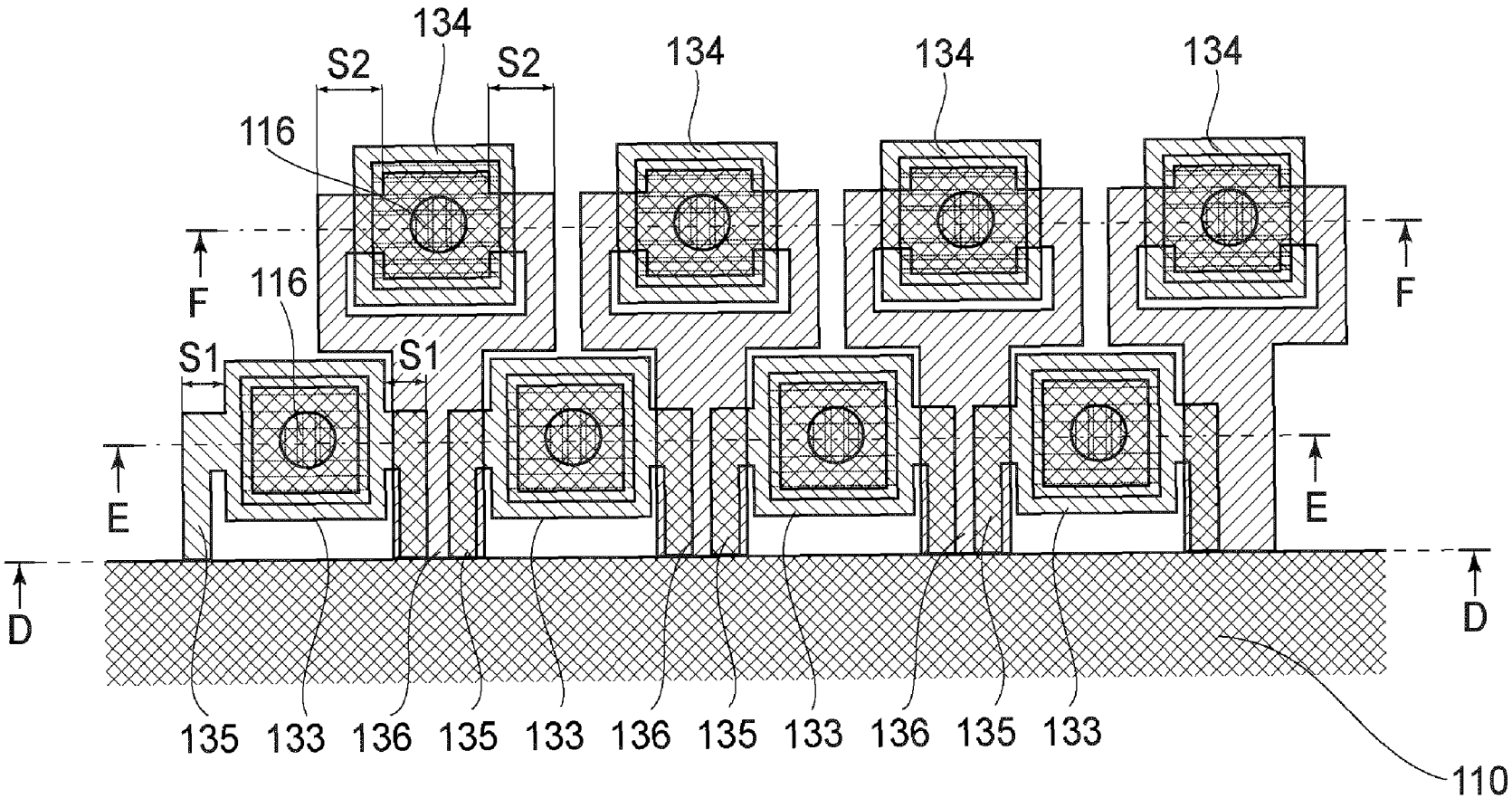
FIG. 11 is a plan view showing a nozzle portion of an ink jet recording head in Fourth Embodiment.
Figure 12:
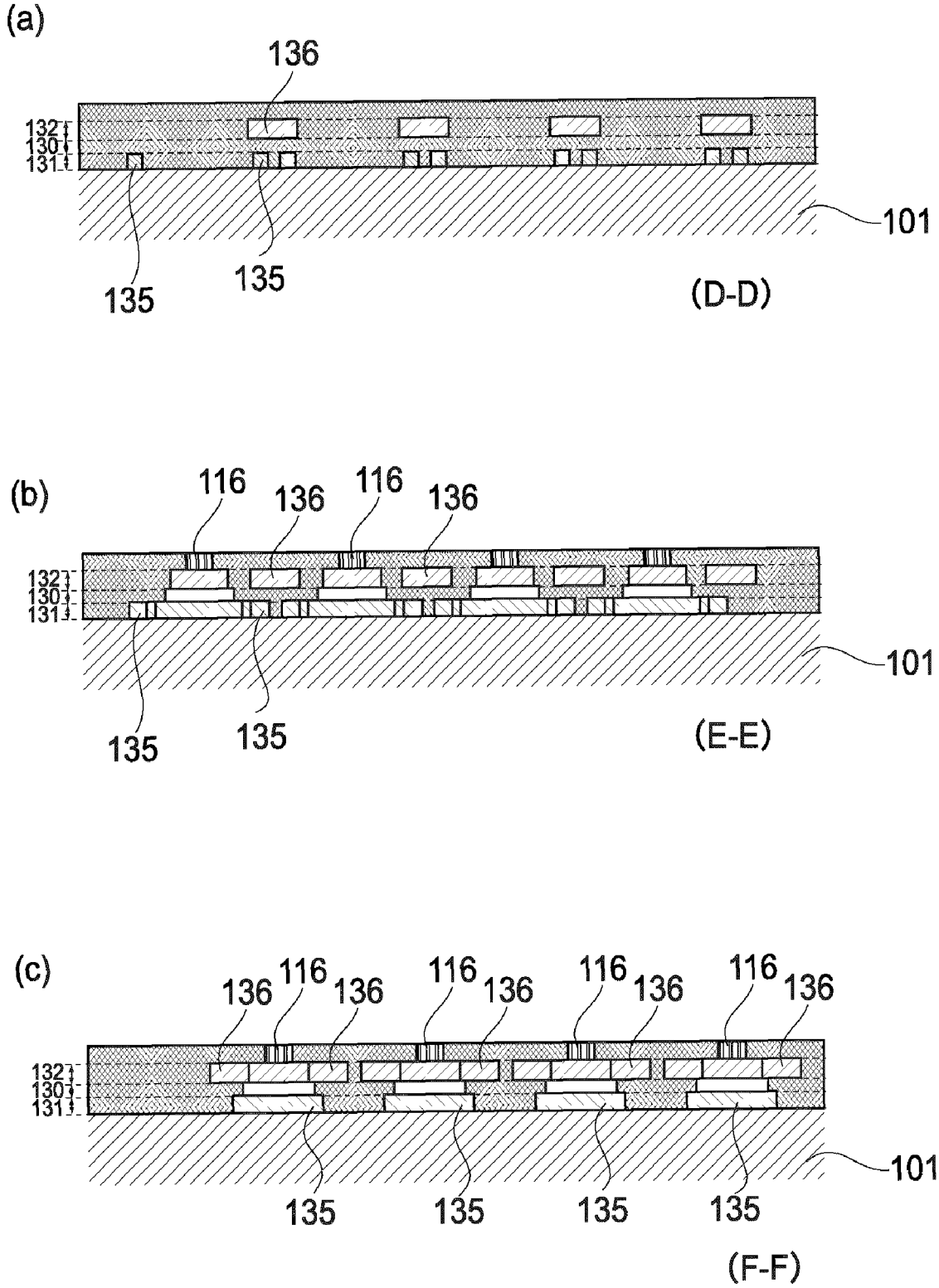
FIGS. 12(*a*) to 12(*c*) are sectional views showing the nozzle portion of the ink jet recording head in Fourth Embodiment.
Figure 13:
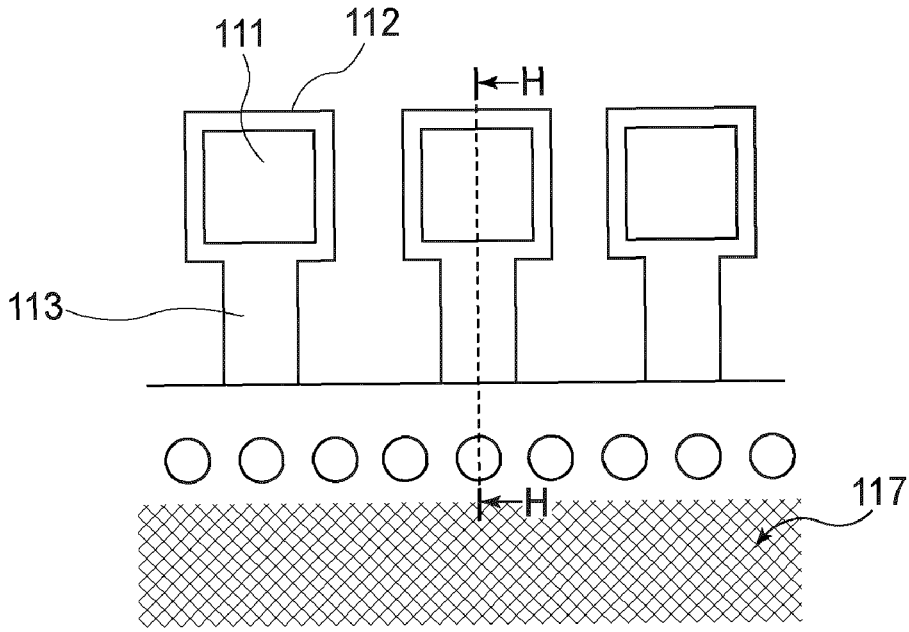
FIGS. 13 to 16 are schematic views showing nozzle portions of conventional ink jet recording heads.
Figure 14:
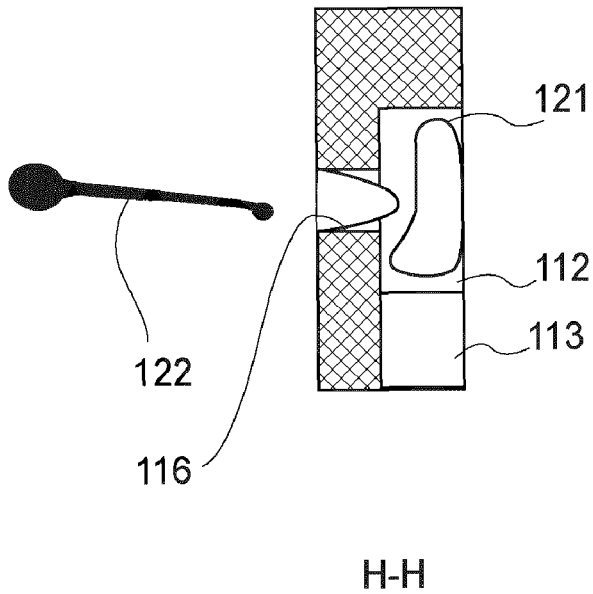
Figure 15:
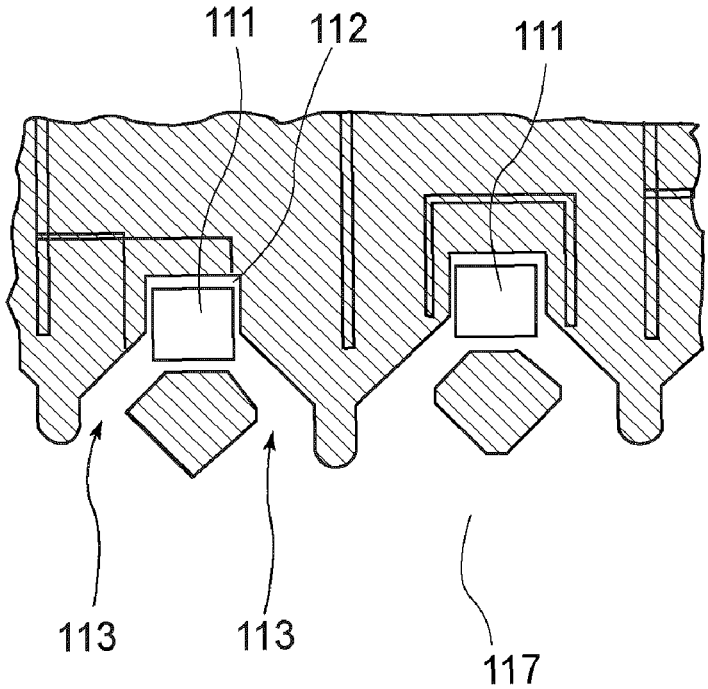
Figure 16:
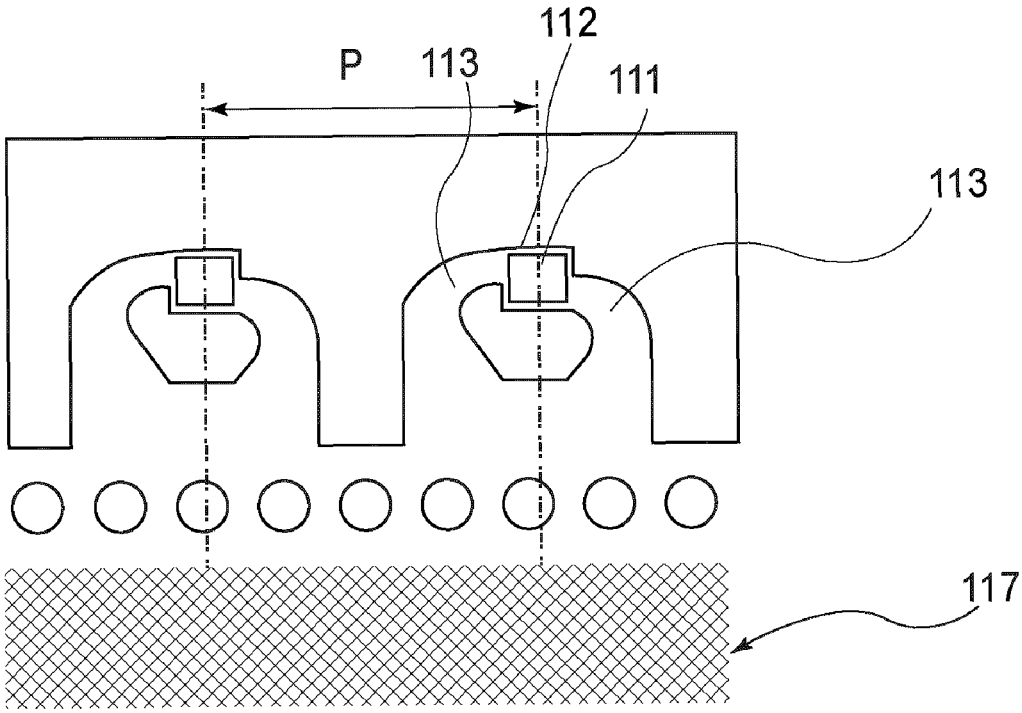

An ink jet recording head of Fourth Embodiment will be described with reference to FIGS. 11 and 12. FIG. 11 is a plan view showing a major portion of the ink jet recording head. FIGS. 12 (*a*), 12(*b*) and 12(*c*) are sectional views taken along D-D line, E-E line, and F-F line, respectively, indicated in FIG. 11.

A difference between this embodiment and First embodiment is that a plurality of ejection outlets 116 disposed on one side of an elongated ink supply port 110 with respect to a short side direction is arranged in a staggered manner such that positions of ejection outlets are deviated with respect to the short side direction of the ink supply port 110. More specifically, the different between this embodiment and First embodiment is that a plurality of ejection outlets 116 disposed on one of both sides sandwiching the ink supply port 110 are alternately arranged in a staggered manner with positional deviation with respect to a direction perpendicular to the nozzle arrangement direction. By this constitution, a density of nozzle arrangement is further improved.

In this embodiment, ink flow paths 135 of nozzles close to the ink supply port 110 are formed by the first flow path layer 131 as shown in FIG. 11 and FIGS. 11(*a*) to 11(*c*). Further, ink flow paths 136 of nozzles away from the ink supply port 110 are formed by the second flow path layer 132. At line-symmetrical positions with respect to a center line, on a principal surface of an unshown heater, perpendicular to the nozzle arrangement direction, ink inlet portions as end portions of each of the ink flow paths 135 and 136 are provided in an associated bubble generation chamber 133 or 134 of a nozzle.

Further, the pair of ink flow paths 135 and the pair of ink flow paths 136 communicate with each other at their end portions communicating with the ink supply port 110 in the first flow path layer 131 and the second flow path layer 132, respectively, in an area close to the ink supply port 110. Further, the pair of ink flow paths 135 and the pair of ink flow paths 136 are disposed at overlapping positions when they are projected on a plane perpendicular to a thickness direction of the silicon substrate 101 in the area close to the ink supply port 110, thus overlapping with each other. The present invention is also applicable to the above described nozzle arrangement constitution improved in recording density by alternately arranging the ejection outlets 116 in the staggered manner by which the ejection outlet 116 with respect to a direction perpendicular to the nozzle arrangement direction are positionally deviated from each other. Further, in this embodiment, the pair of ink flow paths 135 is symmetrically provided to the bubble generation chamber 133 and the pair of ink flow paths 136 is symmetrically provided to the bubble generation chamber 134, so that it is possible to compatibly realize a good ejecting operation and a high density of nozzle arrangement.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 309125/2006 filed Nov. 15, 2006, which is hereby incorporated by reference herein.

What is claimed is:

1. A liquid ejecting head comprising:

a substrate to which elements for generating energy for ejecting liquid and a supply port for supplying the liquid to be ejected are provided;

a plurality of ejection outlets, for ejecting the liquid, provided corresponding to and opposed to the elements;

pressure chambers each communicating with an associated ejection outlet; said pressure chambers including a first associated pressure chamber and a second associated pressure chamber, wherein the first associated pressure chamber and the second associated pressure chamber are adjacent to each other with respect to an arrangement direction of said plurality of ejection outlets; and flow paths communicating between said pressure chambers and the supply port, wherein said flow paths include two first flow path portions connected to the first associated pressure chamber, the two first flow path portions being provided along the arrangement direction of said plurality of ejection outlets and communicating with each other in a straight direction through the first associated pressure chamber, wherein said flow paths further include two second flow path portions connected to the second associated the pressure chamber, the two second flow path portions being provided along the arrangement direction of said plurality of ejection outlets and communicating with each other in a straight direction through the second associated pressure chamber, and wherein one of the first flow path portions that is provided on a side of the second associated pressure chamber and one of the second flow path portions that is provided on a side of the first associated pressure chamber at least partly overlap each other with respect to a direction from said plurality of ejection outlets toward said substrate.

2. A head according to claim 1, wherein the two first flow path portions connected to the first associated pressure chamber are provided symmetrically with respect to the first associated pressure chamber.

3. A head according to claim 1, wherein the supply port has a shape that extends in a direction parallel to the arrangement direction of said plurality of ejection outlets.

4. A head according to claim 1, wherein the supply port includes a plurality of supply port portions provided along the arrangement direction of said plurality of ejection outlets.

5. A head according to claim 1, wherein the first associated pressure chamber includes an integrated portion of the two first flow path portions connected to the first associated pressure chamber, and the second associated pressure chamber is adjacent to the first associated pressure chamber with respect to the arrangement direction of said plurality of ejection outlets, and wherein the integrated portion and one of the two second flow path portions with which the second associated pressure chamber communicates at least partly overlap each other with respect to the direction from said plurality of ejection outlets toward said substrate.

6. A liquid ejecting head comprising: a substrate on which a plurality of ejection outlets for ejecting liquid and a plurality of elements for generating energy for ejecting the liquid are provided, wherein the elements are provided corresponding to the ejection outlets;

a first pressure chamber provided with one of the elements;

a second pressure chamber provided with another of the elements, wherein said second pressure chamber is provided adjacent to said first pressure chamber with respect to an arrangement direction of the plurality of ejection outlets;

a first flow path, provided on a side of second pressure chamber, for supplying the liquid into said first pressure chamber; and a second flow path, provided on a side of said first pressure chamber, for supplying the liquid into said second pressure chamber, wherein said first flow path and said second flow path at least partly overlap each other with respect to a direction from a front surface of said substrate at which the plurality of ejection outlets are provided toward a rear surface of said substrate opposite from the front surface.

7. A head according to claim 6, further comprising:

a third flow path, provided on a side opposite from a side where said first flow path is provided with respect to the arrangement direction of the plurality of ejection outlets, for supplying the liquid into said first pressure chamber; and a fourth flow path, provided on a side opposite from a side where said second flow path is provided with respect to the arrangement direction of the plurality of ejection outlets, for supplying the liquid into said second pressure chamber.

8. A head according to claim 6, further comprising a supply port for supplying the liquid to said first flow path and said second flow path, wherein said supply port has a shape extending in the arrangement direction of the plurality of ejection outlets.

9. A head according to claim 6, further comprising:

a first supply port for supplying the liquid to said first flow path; and a second supply port for supplying the liquid to said second flow path, wherein said first supply port and said second supply port are provided along the arrangement direction of the plurality of ejection outlets.

* * * * *